US010759038B2

(12) United States Patent
Boepple et al.

(10) Patent No.: US 10,759,038 B2
(45) Date of Patent: Sep. 1, 2020

(54) HAND-HELD MACHINE TOOL HAVING A TOOL-CHANGE MAGAZINE

(71) Applicant: Robert Bosch GmbH, Stuttgart (DE)

(72) Inventors: Daniel Boepple, Stuttgart (DE); Simon Erbele, Wildberg (DE)

(73) Assignee: Robert Bosch GmbH, Stuttgart (DE)

( * ) Notice: Subject to any disclaimer, the term of this patent is extended or adjusted under 35 U.S.C. 154(b) by 223 days.

(21) Appl. No.: 16/073,225

(22) PCT Filed: Jan. 16, 2017

(86) PCT No.: PCT/EP2017/050781

§ 371 (c)(1),
(2) Date: Jul. 26, 2018

(87) PCT Pub. No.: WO2017/133886

PCT Pub. Date: Aug. 10, 2017

(65) Prior Publication Data

US 2019/0039229 A1 Feb. 7, 2019

(30) Foreign Application Priority Data

Feb. 3, 2016 (DE) ..... 10 2016 201 653

(51) Int. Cl.
*B25F 5/02* (2006.01)
*B25B 21/00* (2006.01)

(52) U.S. Cl.
CPC ..... *B25F 5/029* (2013.01); *B25B 21/00* (2013.01)

(58) Field of Classification Search
CPC ..... B25B 23/04; B25B 23/06; B25B 23/065; B25B 21/00; B25B 21/002; B25F 5/029
See application file for complete search history.

(56) References Cited

U.S. PATENT DOCUMENTS 5,893,685 A * 4/1999 Olson ..... B25F 5/029 408/124
6,813,977 B2 * 11/2004 Goodhue ..... B25B 23/04 227/137

(Continued)

FOREIGN PATENT DOCUMENTS

DE 10013984 A1 9/2001
DE 102006059688 A1 6/2008

(Continued)

OTHER PUBLICATIONS

International Search Report for PCT/EP2017/050781, dated Apr. 26, 2017.

*Primary Examiner* — David B. Thomas
(74) *Attorney, Agent, or Firm* — Norton Rose Fulbright US LLP; Gerard Messina

(57) ABSTRACT

A hand-held machine tool having a tool receiver to receive an insert tool having an external profile, the tool receiver featuring an internal receiver provided at least sectionally with an internal profile, and having a tool housing assigned a tool-change magazine having at least one tool chamber for storing the insert tool, the tool chamber being alignable with the tool receiver to allow the insert tool to be transferred from the tool chamber into the internal receiver or from the internal receiver into the tool chamber, a positioning device being provided for the circumferential alignment of the external profile when transferring the insert tool from the tool chamber into the internal receiver of the tool receiver to produce a form-locking connection between the internal profile and the external profile that at least for the most part, is free of rotational play, the positioning device has at least one magnet.

12 Claims, 4 Drawing Sheets

(56) References Cited

U.S. PATENT DOCUMENTS

| | | | | |
|---|---|---|---|---|
| 7,562,800 | B2 * | 7/2009 | Goodhue | B25B 23/04 206/338 |
| 9,211,622 | B2 * | 12/2015 | Nagy | B23Q 3/15766 |
| 9,421,681 | B2 * | 8/2016 | Zhang | B25F 5/029 |
| 9,517,538 | B2 * | 12/2016 | Nagy | B25B 23/06 |
| 9,700,977 | B2 * | 7/2017 | Nagy | B25F 5/029 |
| 9,776,295 | B2 * | 10/2017 | Nagy | B25F 1/04 |

FOREIGN PATENT DOCUMENTS

| | | | |
|---|---|---|---|
| DE | 202011110185 | U1 | 2/2013 |
| DE | 102012220835 | A1 | 5/2014 |
| EP | 2599594 | A2 | 6/2013 |

* cited by examiner

HAND-HELD MACHINE TOOL HAVING A TOOL-CHANGE MAGAZINE

FIELD OF THE INVENTION

The present invention relates to a hand-held machine tool having a tool receiver to receive an insert tool provided with an external profile, the tool receiver featuring an internal receiver provided at least sectionally with an internal profile, and having a tool housing which is assigned a tool-change magazine having at least one tool chamber for storing the insert tool, the tool chamber being alignable with the tool receiver in order to allow the insert tool to be transferred from the tool chamber into the internal receiver or from the internal receiver into the tool chamber, a positioning device being provided for the circumferential alignment of the external profile when transferring the insert tool from the tool chamber into the internal receiver of the tool receiver in order to produce a form-locking connection between the internal profile and the external profile that at least for the most part, is free of rotational play.

BACKGROUND INFORMATION

Hand-guided screwdrivers are believed to be understood from the related art, having an integrated, e.g., drum-like bit magazine for keeping a larger number of different screwdriver bits ready. Such screwdrivers have a rotationally driven tool receiver for receiving the screwdriver bits stored in the bit magazine, the screwdriver bits being provided in each case with an external hexagon, for example. In order—as independently of a specific rotational position of the tool receiver as possible—to be able to insert a corresponding external hexagon of a rotational entrainment of a screwdriver bit to be supplied from the bit magazine to the tool receiver, into the tool receiver in a manner free of tilt, i.e., free of resistance, by a purely translatory shifting movement on the part of the user, the tool receiver of the screwdriver is furnished with a rotational entrainer profile provided with multiple longitudinal ribs.

SUMMARY OF THE INVENTION

The present invention relates to a hand-held machine tool having a tool receiver to receive an insert tool provided with an external profile, the tool receiver featuring an internal receiver provided at least sectionally with an internal profile, and having a tool housing which is assigned a tool-change magazine having at least one tool chamber for storing the insert tool, the tool chamber being alignable with the tool receiver in order to allow the insert tool to be transferred from the tool chamber into the internal receiver or from the internal receiver into the tool chamber. A positioning device is provided for the circumferential alignment of the external profile when transferring the insert tool from the tool chamber into the internal receiver of the tool receiver in order to produce a form-locking connection between the internal profile and the external profile that at least for the most part, is free of rotational play. The positioning device has at least one magnet which is provided to align the insert tool relative to the internal profile upon insertion of the insert tool into the internal receiver.

An unfailingly tilt-free, resistance-free insertion of the insert tool into the tool receiver is thus ensured, regardless of its circumferential starting position within the tool chamber. Therefore, a seating of the screwdriver bit in the tool receiver that is marked by rotational play which, among other things, reduces the perceived quality of the screwdriver, may at least for the most part be prevented. Moreover, an undesirable limitation of a maximum torque transferable between the tool receiver and a corresponding screwdriver bit may be increased, and because of the form-locking connection that is at least substantially free of rotational play, a time lag when changing the direction of rotation of the insert tool may effectively be prevented. In addition, owing to the magnet, the circumferential alignment of an insert tool is accomplished without mechanically moving components such as spring elements or the like. To this end, the insert tool may be formed with a magnetic material.

According to one specific embodiment, the external profile of the insert tool is an external polygon and the internal profile of the internal receiver is an internal polygon. The external polygon may be an external hexagon and the internal polygon is an internal hexagon.

Consequently, a large number of standardized insert tools customary in the marketplace like, for example, familiar screwdriver bits or the like, may be used.

The internal polygon may be formed at least sectionally in a sleeve-like tool-receiver section of the tool receiver, and the at least one magnet of the positioning device is disposed in the sleeve-like tool-receiver section.

Thus, reliable circumferential tilting of the insert tool into the correct insertion position is already provided.

The internal polygon may have a centering section.

The insert tool is thereby centered radially upon insertion into the tool receiver.

In a further technically advantageous development, when the insert tool is in the at least partially inserted state, at least one radially inwardly directed magnetic surface of the at least one magnet and at least one polygon surface of the external polygon lie side by side in parallel, at least in some areas.

Because of this circumstance, the insertion position, once reached with the aid of the magnetic positioning device, is maintained permanently, regardless of changes in the position of the hand-held machine tool, vibrations or the like.

The at least one magnetic surface and the at least one polygon surface of the external polygon of the insert tool may be offset circumferentially by a maximum of 20° relative to each other when the polygon surface reaches the at least one magnet.

Reliable tilting of the insert tool about its longitudinal central axis is thereby ensured.

The at least one magnetic surface and the at least one polygon surface of the external polygon of the insert tool may be set apart from each other by a maximum of 2 mm.

Reliable tilting of the insert tool about its longitudinal central axis is ensured as a result of this, as well.

According to one further development, the positioning device has at least one further magnet which, in relation to a longitudinal central axis of the insert tool, is offset by an angle not equal to 60° or not equal to a multiple of 60° relative to the at least one magnet.

Tilting of the insert tool about its longitudinal central axis may thus be further optimized.

In one embodiment, the at least one magnet of the positioning device is formed by a permanent magnet or by a magnetized area of the sleeve-like tool-receiver section.

The magnet is thereby integrated into the hand-held machine tool especially easily from the standpoint of manufacturing technology.

The insert tool may be transferable out of the tool chamber into the internal receiver of the tool receiver and out of the internal receiver back into the tool chamber with the aid of a transfer mechanism, especially a push bar.

As a result, the tool-change mechanism is operable intuitively for an operator.

One free end section of the push bar facing the insert tool may be magnetized.

Thus, a reliable axial coupling is provided between the insert tool and the push bar which, however, is easily releasable again if necessary.

The at least one magnet may be provided to rotate the insert tool about a longitudinal central axis of the insert tool in such a way that, upon insertion of the insert tool into the internal receiver, the cross-section of the external profile of the insert tool is located completely within the internal profile of the internal receiver.

The process of transferring the insert tool from the tool chamber into the tool receiver may thus be further improved.

The present invention is explained in greater detail in the following description on the basis of exemplary embodiments shown in the drawing. Identical or identically acting components are provided here with the same reference numerals and in each case are described only once.

DETAILED DESCRIPTION

Figure 1:
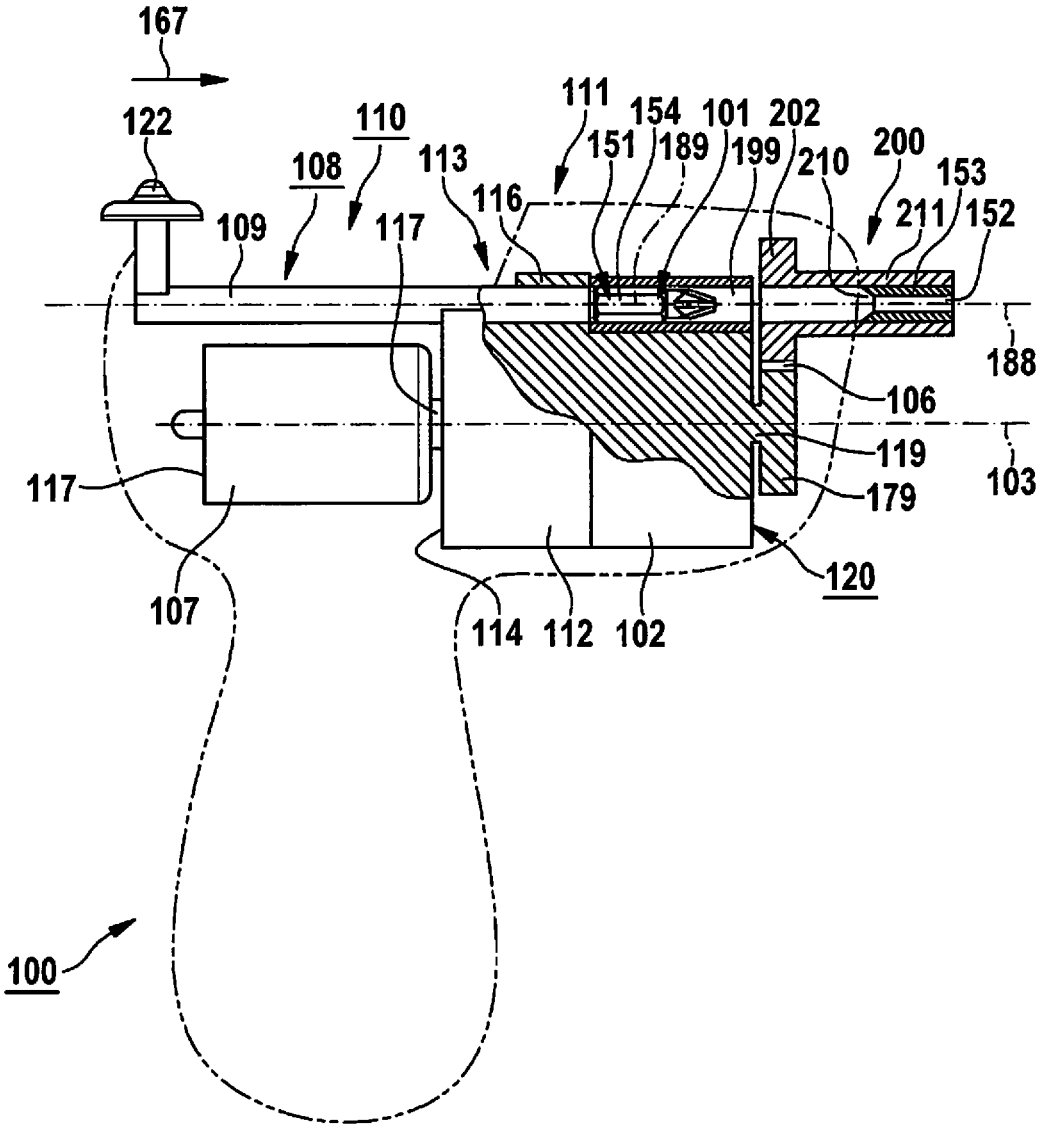
FIG. 1 shows a schematic, partial cutaway side view of a hand-held machine tool having a tool-change magazine and a tool receiver according to one specific embodiment.

FIG. 1 shows as example a machine tool 100 able to be guided manually and powered by motor, also referred to hereinafter as "hand-held machine tool." It may have a tool housing 111, in which a tool-change magazine 120 is disposed. According to one specific embodiment, tool-change magazine 120 is drum-like and is rotatable about an axis of rotation 103. Illustratively, tool-change magazine 120 is in the form of a hollow cylinder having a ring-like casing body 102, in which a plurality of tool chambers is provided. For example, insert tools may be disposed in the tool chambers, it being possible, for instance, to provide different insert tools in all tool chambers. For the purpose of clarity and simplicity of the drawing, only one tool chamber is indicated in FIG. 1 and identified by reference numeral 199. Disposed as illustration in this tool chamber 199 is an insert tool 101 that is exemplified here as a screwdriver bit.

Hand-held machine tool 100 is formed illustratively in the manner of what is referred to as a bit screwdriver for the comfortable handling of so-called "screwdriver bits." However, it is pointed out that the present invention is not limited to such bit screwdrivers, but rather may be used for all machine tools in which a tool-change magazine, especially a drum-like tool-change magazine rotatable about a longitudinal axis, is able to be used, regardless of whether screwdriver bits or other interchangeable objects are stored in the tool-change magazine, or whether or not the machine tool is able to be held or guided manually.

A tool receiver 200 for receiving insert tool 101 is disposed illustratively on tool housing 111, tool receiver 200 being rotatable about an assigned axis of rotation 188 or a longitudinal central axis. In order to drive insert tool 101, tool receiver 200 is coupled illustratively via a gear toothing 106 to an output shaft 119 of a gear unit 112 that is disposed, by way of example, in a gear housing 114. To that end, provided as illustration on output shaft 119 is a driving gear wheel 179 which interacts in gear toothing 106 with an output gear wheel 202 provided on tool receiver 200. For instance, output shaft 119 is driven rotationally by a motor shaft 177 of a drive motor 107 that is coupled to gear unit 112 and is disposed, e.g., in an assigned motor housing 117, motor housing 117 and gear housing 114 being mounted and secured in tool housing 111, for example.

Among other things, tool receiver 200 has an internal receiver 210 provided with an internal profile 152. By way of example, internal profile 152 of internal receiver 210 is an internal polygon 153, and an external profile 151 of insert tool 101 is realized by an exemplary external polygon 154 that corresponds to internal polygon 153 and is axially symmetrical with respect to a longitudinal central axis 189 of insert tool 101. Internal polygon 153 may be an internal hexagon, whose center axis corresponds to axis of rotation 188, and is therefore also referred to hereinafter as "internal hexagon 153," while external polygon 154 may be an external hexagon, and is therefore also referred to hereinafter as "external hexagon 154."

Internal hexagon 153 may be located at least sectionally in a sleeve-like tool-receiver section 211 of internal receiver 210, into which external hexagon 154 of insert tool 101 is insertable axially upon transferring it from tool chamber 199 in order to produce a form-locking connection with tool receiver 200 that may be essentially free of rotational play. To that end, tool chamber 199 may be oriented in stay-put fashion in such a way that rotational or center axis 188 is in alignment with longitudinal central axis 189 of insert tool 101.

In order to slip insert tool 101 out of tool chamber 199 into internal receiver 210 of tool receiver 200 and to slip it out of internal receiver 210 into tool chamber 199, a transfer mechanism 110 is provided. It has a transfer element 108 formed, for example, in the manner of a push bar 109 operable via an operating element 122. For instance, push bar 109 is guided axially in a guideway 116 provided on gear housing 114 (compare especially FIG. 5). At its axial end facing insert tool 101, push bar 109 may be magnetized for the magnetic connection with insert tool 101. For this purpose, operating element 122 may be displaceable axially in an opening 113, provided on tool housing 111, parallel to axis of rotation 188 of tool receiver 200 and of longitudinal central axis 189 of insert tool 101, respectively. As an alternative, however, a non-parallel displaceability may also be realized.

When changing a tool in hand-held machine tool 100, tool-change magazine 120 may be rotated about axis of rotation 103 into a tool-change position in which, for example, tool chamber 199 with insert tool 101 is in alignment with tool receiver 200 or, more specifically, with its internal receiver 210. Operating element 122 is then shifted in the direction of an arrow 167 in opening 113 from its rear axial end position in FIG. 1 up to a front axial end position, in which push bar 109 passes through tool chamber 199 and locks insert tool 101 in internal receiver 210 of tool receiver 200. To transfer tool 101 out of tool receiver 200 into tool chamber 199, operating element 122 is then shifted axially in opening 113 in a direction opposite to arrow 167, back into its rear axial end position.

However, it should be pointed out that the fundamental operating principle and the configuration of hand-held machine tool 100 are already known from the German Patent DE 10 2006 059 688 A1, which in addition, for example, describes adjusting means for rotating tool-change magazine 120 about axis of rotation 103, in order to facilitate alignment of tool chamber 199 with tool receiver 200. Therefore, the disclosure of DE 10 2006 059 688 A1 is incorporated explicitly into the present description, in order to simplify it.

Figure 2:
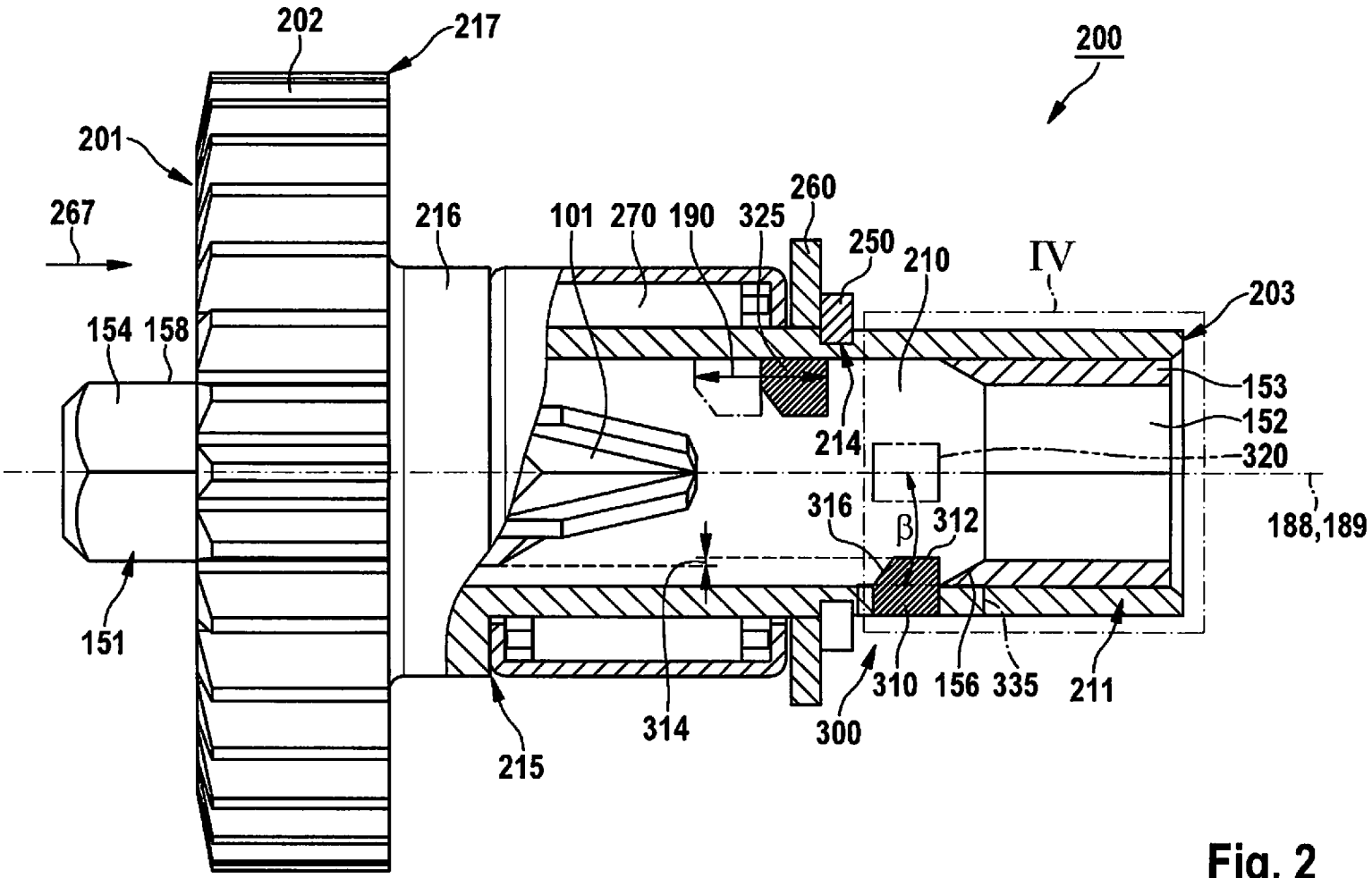
FIG. 2 shows a partial cutaway side view of the tool receiver from FIG. 1 according to one specific embodiment.

FIG. 2 shows tool receiver 200 from FIG. 1 upon the transfer of insert tool 101 in the direction of an arrow 267 into tool receiver 200 rotatable about axis of rotation 188 and longitudinal central axis 189, respectively, and having sleeve-like tool-receiver section 211. Illustratively, at a first axial end section 201, tool receiver 200 has output gear wheel 202 from FIG. 1, while internal hexagon 153 of internal profile 152 of internal receiver 210 is located at an opposite second axial end section 203, internal hexagon 153 may be used for the accommodation, essentially free of rotational play, of external profile 151 of insert tool 101 implemented as external hexagon 154.

In the area of a first shoulder 217 of output gear wheel 202, tool receiver 200 may change over into a first tapered area 216, which may at a second shoulder 215, changes into tool-receiver section 211. Mounted illustratively on tool-receiver section 211 is a roller bearing 270, formed in the manner of a needle roller bearing, for the rotationally movable support of tool receiver 200 in tool housing 111 (see FIG. 1). For example, roller bearing 270 is fixed in position in axially immovable manner between first tapered area 216 and a locking disk 260. On its part, locking disk 260 is blocked in the axial direction of tool receiver 200 by a retaining ring 250, e.g., a C-clip, which may be secured in an annular groove 214 formed on tool-receiver section 211.

Internal hexagon 153 of internal profile 152 of internal receiver 210 may have a centering section 156 directed away from second axial end section 203 and beveled illustratively in conical or wedge-shaped fashion. Centering section 156 may be used for the radial centering of insert tool 101 upon its insertion into tool receiver 200.

In an axial area between retaining ring 250 and centering section 156, sleeve-like tool-receiver section 211 has a magnetic positioning device 300, which is used for the circumferential alignment of external profile 151 of insert tool 101 upon its transfer into internal receiver 210, creating a form-locking connection, which may be essentially free of rotational play, between internal profile 152, or rather internal hexagon 153 and external profile 151, or rather external hexagon 154. For this purpose, positioning device 300 may have at least one magnet 310, which is provided to align insert tool 101 relative to internal profile 152 during its insertion into internal receiver 210. The at least one magnet 310 may be provided to rotate insert tool 101 about its longitudinal central axis 189, in each case to the extent that upon axial insertion of insert tool 101 into internal receiver 210, a cross-section of external profile 151 of insert tool 101 lies completely within internal profile 152 or is congruent with it. In the state in which insert tool 101 is inserted at least partially into internal receiver 210 (see especially FIG. 3), at least one radially inwardly directed magnetic surface 312 and at least one hexagon surface 158 of insert tool 101 may lie close to one another, at least in some areas.

It should be pointed out that centering section 156 is merely optional, so that in an alternative realization, it is possible to dispense with provision of this centering section 156. For example, this is the case in the event that the at least one magnet 310 is positioned sufficiently precisely in sleeve-like tool-receiver section 211.

Magnetic surface 312, which runs parallel to axis of rotation 188 and longitudinal central axis 189, respectively, and may be planar, and hexagon surface 158 may be apart from each other here by a radial distance 314 of a maximum of 2 mm in order, inter alia, to reliably ensure adequate action of force of magnet 310 on insert tool 101. Upon the axial approach to magnet 310, the one magnetic surface 312 and the at least one hexagon surface 158 of external hexagon 154 of insert tool 101 may be offset circumferentially by a maximum of 20° relative to each other. In addition, magnet 310 may have a centering surface 316, running at an angle here of, e.g., approximately 45° in relation to axis of rotation 188 and longitudinal central axis 189, respectively, which is facing in the direction of first axial end section 201 and therefore further facilitates the axial insertion of insert tool 101 into tool receiver 200.

In addition, positioning device 300 may have one or more further magnets 320 which, in relation to axis of rotation 188 or longitudinal central axis 189 of tool receiver 200, is/are offset circumferentially relative to magnet 310 by an angle ß, only indicated graphically, which may be not equal to 60° or not equal to a multiple thereof. Moreover, positioning device 300 may have at least one further, axially displaceable magnet 325 to further optimize the process of inserting insert tool 101 into tool receiver 200. This axially displaceable magnet 325 may be movable in the axial direction of tool receiver 200 at least for a short distance 190 together with insert tool 101 to be inserted into tool receiver 200, so that the correct circumferential position of insert tool 101 in relation to internal receiver 210 is maintained for a longer movement range.

Magnets 310, 320, 325 may be formed by permanent magnets as separate components and/or integrally with magnetized areas of sleeve-like tool-receiver section 211, provided it is produced with a ferromagnetic material. The permanent magnets may be produced with rare-earth elements by sintering, etc. One magnetized area 335 of the magnetized areas or zones is denoted representatively for all the rest.

Figure 3:
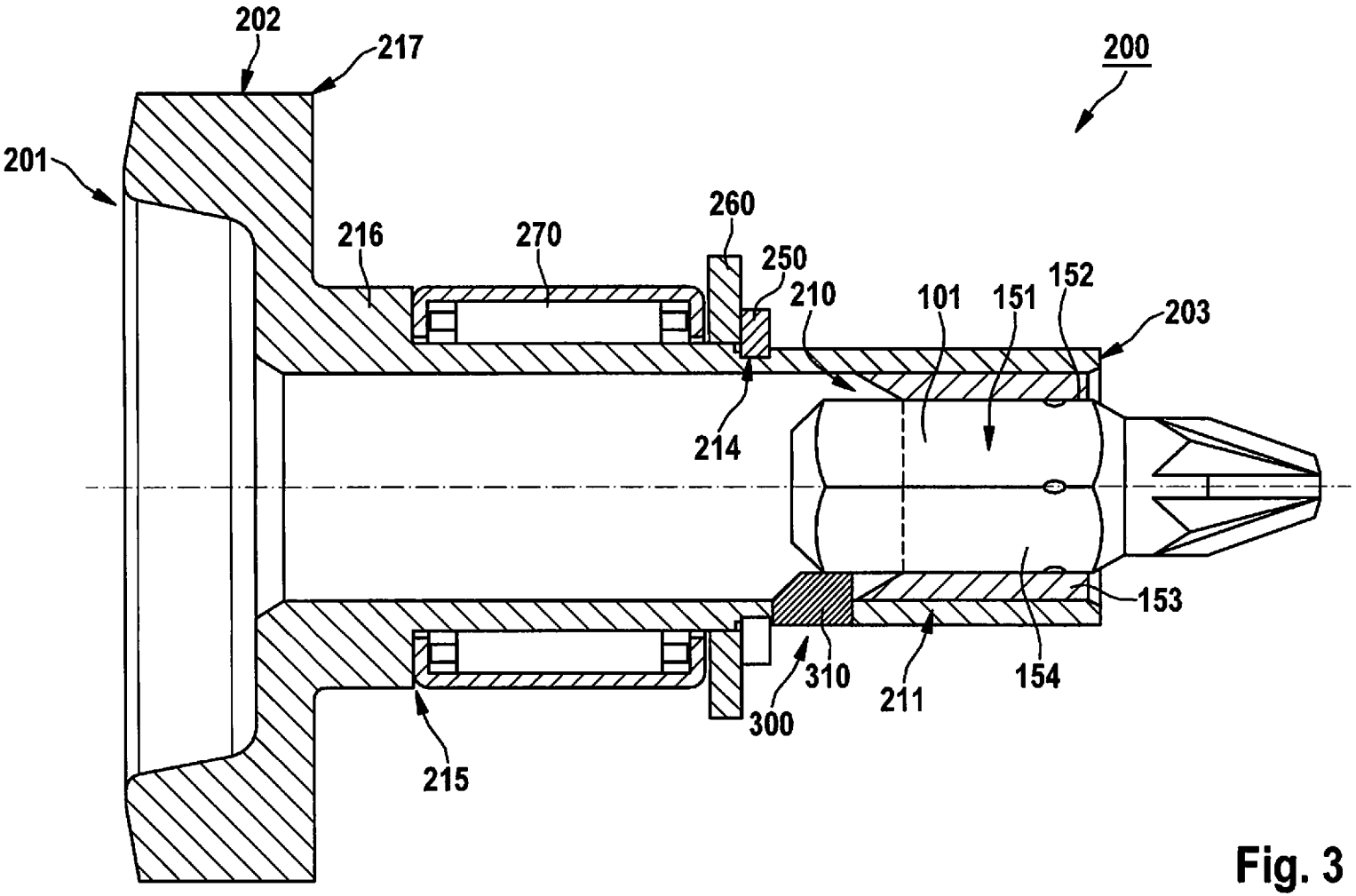
FIG. 3 shows a sectional view of the tool receiver from FIG. 2 with the insert tool from FIG. 1 positioned in it.

FIG. 3 shows tool receiver 200 from FIG. 2 with insert tool 101 from FIG. 1 positioned in it after the complete axial insertion of insert tool 101 into internal receiver 210 of tool receiver 200. In this completely inserted state, external profile 151, or more precisely, external hexagon 154 of insert tool 101 is accommodated in internal profile 152, or rather internal hexagon 153 of tool-receiver section 211 with the aid of a form-locking connection that by preference is free of rotational play, but at least is mostly free of rotational play.

Figure 4:
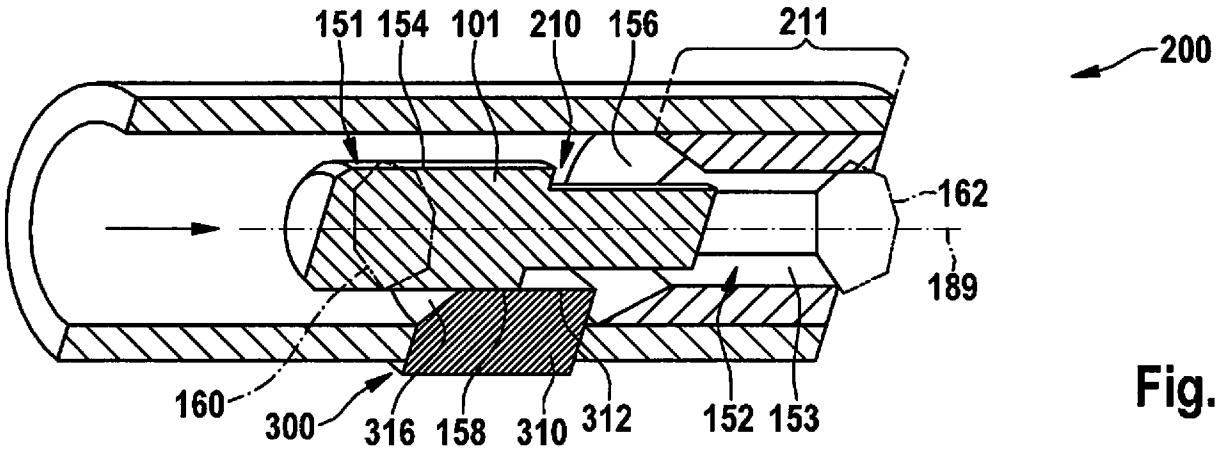
FIG. 4 shows an enlarged perspective view of a segment IV from FIG. 2.

FIG. 4 shows external profile 151, or more specifically, external hexagon 154 of insert tool 101 upon sliding past magnet 310 of positioning device 300, whereby insert tool 101 is rotated about its longitudinal central axis 189 in such a way that magnetic surface 312 abuts what may be full-surface on hexagon surface 158, and thus a cross-section 160 of external profile 151 of insert tool 101 is aligned congruently with a cross-section 162 of internal profile 152 of tool receiver 200. Consequently, insert tool 101 is able to be inserted virtually without resistance into internal receiver 210 with the aid of the transfer mechanism from FIG. 1, while at the same time creating a form-locking connection with internal receiver 210 of tool receiver 200 that is essentially free of rotational play.

Internal hexagon 153 is formed axially, at least sectionally, in sleeve-like tool-receiver section 211 of internal receiver 210 of tool receiver 200. Centering section 156—expanding in funnel-shaped or conical manner opposite to the insertion direction of insert tool 101 indicated by an arrow—in tool receiver 200 is used to further optimize the transfer process.

Figure 5:
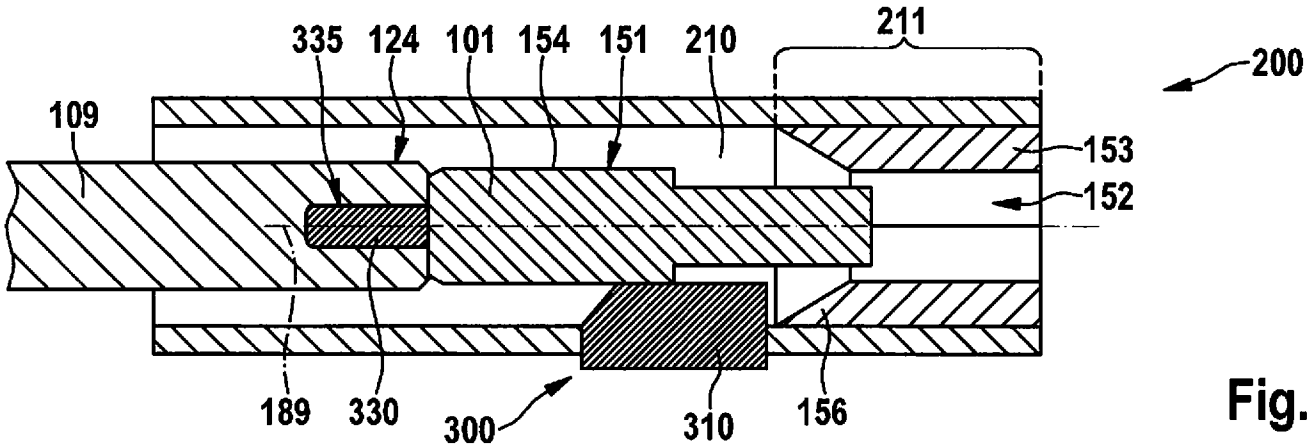
FIG. 5 shows the tool receiver from FIG. 4 with a push bar as transfer mechanism.

FIG. 5 shows tool receiver 200 from FIG. 4 with a push bar 109 as a part of a transfer mechanism (compare especially FIG. 1). This push bar 109 may be magnetized in area 335 of its free end 124, that is to say, has a magnet 330 or a magnetized area at its free end 124, whereby an axial connection is provided between insert tool 101 and push bar 109 that is sufficiently strong mechanically, but is easily releasable again if necessary. Consequently, in addition to implementing a change of insert tool 101, insert tool 101 is able to be pulled without difficulty out of internal receiver 210 again with the aid of push bar 109.

Magnet 330 or magnetized area 335 may be formed centrically in relation to longitudinal central axis 189 of insert tool 101 within free end 124 of push bar 109. In this case, magnet 330 may be formed as a separate component and secured in suitable manner in free end 124 of push bar 109, e.g., by press-fitting, thermal shrinkage, gluing in place, caulking, etc. If push bar 109 is formed with a ferromagnetic material, free end 124 may itself also be magnetized.

Illustratively, in FIG. 5, insert tool 101 is once again situated in the axial direction just before the state of complete insertion into tool receiver 200, in which state, a form-locking connection, essentially free of rotational play, exists between external hexagon 154 of insert tool 101 and internal hexagon 153 of tool-receiver section 211 of internal receiver 210 of tool receiver 200.

What is claimed is:

1. A hand-held machine tool, comprising:

a tool receiver to receive an insert tool provided with an external profile, wherein the tool receiver includes an internal receiver provided at least sectionally with an internal profile;

a tool housing, which is assigned a tool-change magazine having at least one tool chamber for storing the insert tool, wherein the tool chamber is alignable with the tool receiver to allow the insert tool to be transferred from the tool chamber into the internal receiver or from the internal receiver into the tool chamber; and a positioning device for providing circumferential alignment of the external profile when transferring the insert tool from the tool chamber into the internal receiver of the tool receiver to produce a form-locking connection between the internal profile and the external profile that at least for the most part, is free of rotational play;

wherein the positioning device includes at least one magnet to align the insert tool relative to the internal profile upon insertion of the insert tool into the internal receiver.

2. The hand-held machine tool of claim 1, wherein the external profile of the insert tool is an external polygon and the internal profile of the internal receiver is an internal polygon.

3. The hand-held machine tool of claim 1, wherein the internal polygon is formed at least sectionally in a sleeve-like tool-receiver section of the tool receiver, and the at least one magnet of the positioning device is disposed in the sleeve-like tool-receiver section.

4. The hand-held machine tool of claim 1, wherein the internal polygon has a centering section.

5. The hand-held machine tool of claim 1, wherein when the insert tool is in the at least partially inserted state, at least one radially inwardly directed magnetic surface of the at least one magnet and at least one polygon surface of the external polygon lie side by side in parallel, at least in some areas.

6. The hand-held machine tool of claim 5, wherein the at least one magnetic surface and the at least one polygon surface of the external polygon of the insert tool are offset circumferentially by a maximum of 20° relative to each other when the polygon surface reaches the at least one magnet.

7. The hand-held machine tool of claim 5, wherein the at least one magnetic surface and the at least one polygon surface of the external polygon of the insert tool are set apart from each other by a maximum of 2 mm.

8. The hand-held machine tool of claim 1, wherein the positioning device has at least one further magnet which, in relation to a longitudinal central axis of the insert tool, is offset by an angle not equal to 60° or not equal to a multiple of 60° relative to the at least one magnet.

9. The hand-held machine tool of claim 1, wherein the at least one magnet of the positioning device is formed by a permanent magnet or by a magnetized area of the sleeve-like tool-receiver section.

10. The hand-held machine tool of claim 1, wherein the insert tool is able to be transferred out of the tool chamber into the internal receiver of the tool receiver and out of the internal receiver back into the tool chamber with the aid of a transfer mechanism, especially a push bar.

11. The hand-held machine tool of claim 10, wherein one free end section of the push bar facing the insert tool is magnetized.

12. The hand-held machine tool of claim 1, wherein the at least one magnet is provided to rotate the insert tool about a longitudinal central axis of the insert tool in such a way that, upon insertion of the insert tool into the internal receiver, the cross-section of the external profile of the insert tool is located completely within the internal profile of the internal receiver.

* * * * *